US005852911A

United States Patent [19]

Yuyama et al.

[11] Patent Number: 5,852,911

[45] Date of Patent: Dec. 29, 1998

[54] TABLET DISPENSER

[75] Inventors: Shoji Yuyama; Keita Yasuoka, both of Toyonaka, Japan

[73] Assignee: Kabushiki Kaisha Yuyama Seisakusho, Toyonaka, Japan

[21] Appl. No.: 796,816

[22] Filed: Feb. 6, 1997

[30] Foreign Application Priority Data

Feb. 7, 1996 [JP] Japan ..... 8-021307

[51] Int. Cl.[6] ..... B65B 35/54

[52] U.S. Cl. ..... 53/168; 53/154; 53/155; 53/237; 53/238; 53/52; 221/6; 221/8; 221/10; 221/17; 364/479.12; 364/479.14

[58] Field of Search ..... 364/478.02, 478.03, 364/478.04, 478.07, 478.13, 478.14, 479.01, 479.02, 479.05, 479.06, 479.07, 479.11, 479.12, 479.13, 479.14; 221/1, 2, 6, 8, 9, 10, 11, 17, 94, 95, 112, 113, 119, 121, 123, 124, 132, 133, 287; 53/50, 53, 54, 154, 155, 168, 501, 494, 495, 445, 474, 237, 238, 240, 52

[56] References Cited

U.S. PATENT DOCUMENTS

| | | | |
|---|---|---|---|
| 5,084,828 | 1/1992 | Kaufman et al. | 364/479.12 |
| 5,097,652 | 3/1992 | Inamura et al. | 53/154 X |
| 5,208,762 | 5/1993 | Charhut et al. | 364/478.04 |
| 5,405,048 | 4/1995 | Rogers et al. | 221/17 X |
| 5,502,944 | 4/1996 | Kraft et al. | 53/168 X |

FOREIGN PATENT DOCUMENTS

| | | | |
|---|---|---|---|
| 4-102168 | 4/1992 | Japan . | |
| 5132004 | 5/1993 | Japan | 53/168 |

*Primary Examiner*—Daniel Moon
*Attorney, Agent, or Firm*—Wenderoth, Lind & Ponack, L.L.P.

[57] ABSTRACT

A tablet dispenser having a control unit which can eliminate the possibility of erroneously putting tablets in a wrong tablet storage space. The tablet dispenser has a tablet storage unit and a packing unit. Tablets designated by drug information are dropped from the tablet storage unit. When tablets in any of a plurality of tablet storage cells in the tablet storage unit run short, tablets are manually supplied into this cell by opening its cover. Before supplying tablets, the control unit reads a code on the tablet container with a bar code reader, compares this code with a code that represents tablets to be supplied into the above particular cell, and indicates on a display if these codes coincide. An operator checks the display to see if the codes coincide, and if they do, the operator then supplies tablets in the tablet container into the particular cell.

2 Claims, 11 Drawing Sheets

TABLET DISPENSER

BACKGROUND OF THE INVENTION

This invention relates to a tablet dispenser comprising a tablet storage unit having a plurality of tablet storage cells containing different kinds of tablets, a discharge means for discharging tablets from a designated storage cell, and a tablet packing unit for packing the tablets discharged from the cell.

Many different kinds of tablet dispensers are known. A typical tablet dispenser comprises a tablet storage unit, a discharge unit, a printer, a drug pouch sealer, drug pouch feeder, a cutter, etc.

An ordinary tablet dispenser stores several hundred kinds of tablets. When any tablet storage cell runs short of tablets, it has to be replenished with tablets. Unexamined Japanese Patent Publication 4-102168 proposes a tablet dispenser capable of stocktaking for replenishing tablets. This device has a tablet storage unit partitioned into a plurality of cells arranged in a lattice pattern and each detachably keeping a tablet case having a drive unit for discharging tablets stored in the tablet case. The tablets discharged are dropped into a packing unit and packed.

This device has a means for calculating the number of tablets stored in each tablet case and indicating it on a display, so that an operator can easily check which tablet case is short of tablets.

When a certain tablet case runs short of tablets, fresh tablets have to be replenished manually.

Such a tablet dispenser keeps a great many kinds (e.g. 200 kinds) of tablets, and some of these tablets are very similar in shape, size and color. Thus, it is difficult to completely eliminate the possibility of a pharmacist erroneously putting tablets in a wrong tablet case, e.g. in a tablet case next to the intended tablet case.

Such an error is rarely discovered because once tablets are put in tablet cases, they are discharged and packed without being seen by anyone. The wrong tablets will thus be prescribed to a patient. In the worst case, such wrong tablets could kill the patient.

An object of the present invention is to provide a tablet dispenser having a means which can eliminate the possibility of erroneously putting tablets in an incorrect tablet storage space.

SUMMARY OF THE INVENTION

According to this invention, there is provided a tablet dispenser comprising a tablet storage unit having a plurality of tablet storage spaces in which are stored different kinds of tablets, each of the storage spaces having a cover which can be manually opened, a tablet discharge means for discharging tablets from a designated one of the tablet storage spaces, a hopper provided under the tablet storage unit for receiving tablets discharged from the designated one of the tablet storage spaces, a tablet packing unit for receiving tablets from the hopper and packing the tablets, and a control means for comparing a first code on a tablet container that represents the kind of tablets contained in the tablet container with a second code of tablets to be supplied into one of the tablet storage spaces to judge whether or not the first and second codes coincide, and indicating the fact that the two codes coincide on a display means if the two codes coincide, whereby an operator can open the cover of the one of the tablet storage spaces and supply tablets in the tablet container into the one of the tablet storage spaces.

In another arrangement, the control unit reads a code attached to the cover of each of the plurality of tablet storage spaces and representing the kind of tablets stored in this tablet storage space, and compares this code with the first and second codes in order to judge whether or not the three codes are identical.

Except for the control means, the tablet dispenser of the first invention is basically the same in structure and function as conventional tablet dispensers. The dispensing mechanism may be any of the three types to be described hereinbelow or any other conventional type which can drop tablets from a selected tablet storage space, guide them to a predetermined position with a hopper and pack them.

Each tablet storage space has a cover, which has to be opened to supply tablets in the storage space. The cover keeps tablets in the space free of moisture.

To resupply tablets into a particular tablet storage space, the code on a tablet container is compared with the code of tablets which has to be supplied into the particular tablet storage space. If they are identical, this means that the tablets in the tablet container are the right kind. Thus, they are supplied into the tablet storage space.

In another arrangement, the above two codes are compared further with the code attached on the cover of the particular tablet storage space to further reduce the possibility of supplying wrong tablets into a predetermined tablet storage space.

Other features and objects of the present invention will become apparent from the following description made with reference to the accompanying drawings, in which:

DETAILED DESCRIPTION OF THE PREFERRED EMBODIMENT

Embodiments of this invention will now be described with reference to the drawings.

Figure 1:
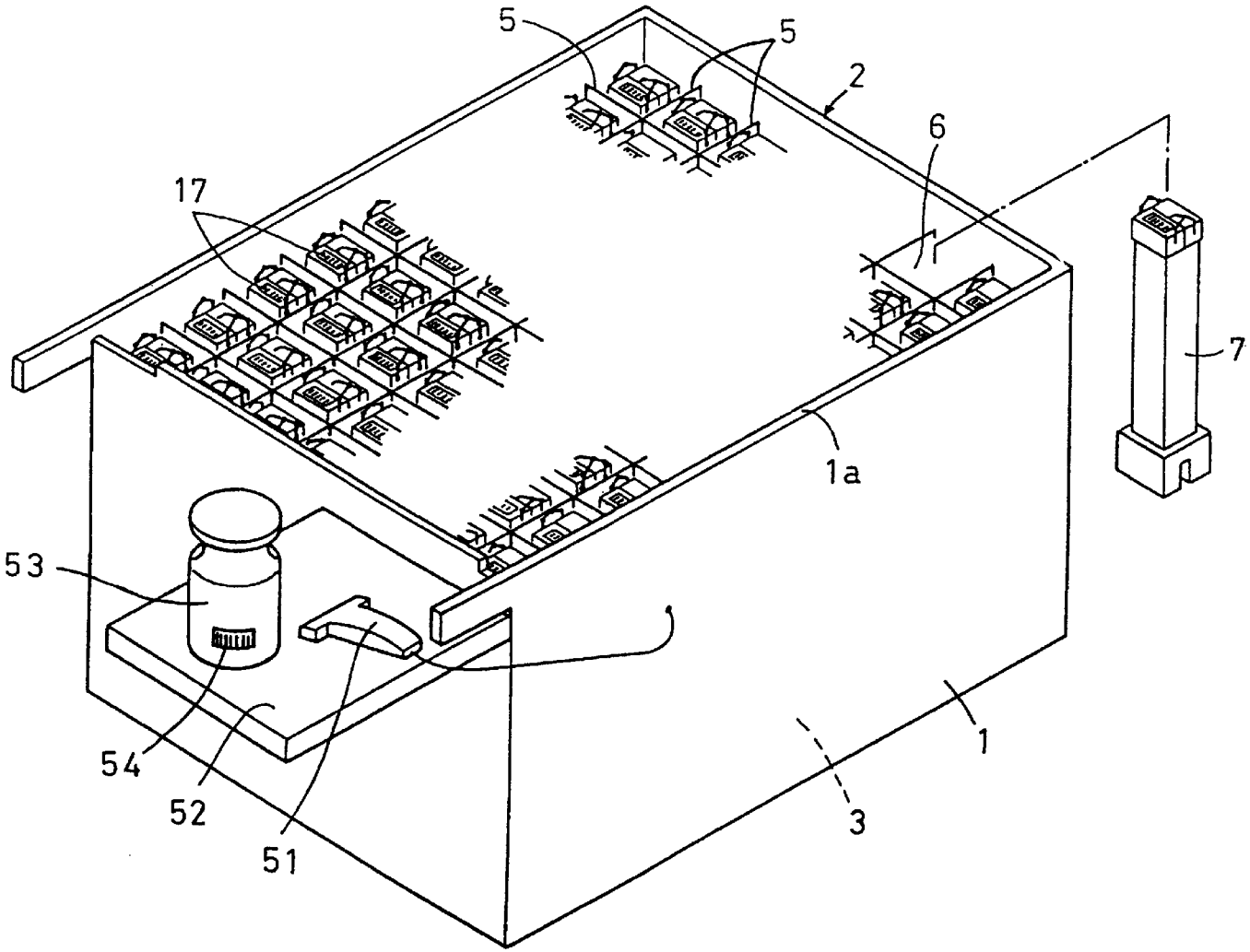
FIG. 1 is a schematic perspective view of an entire tablet packing device of a first embodiment of the present invention.
Figure 2:
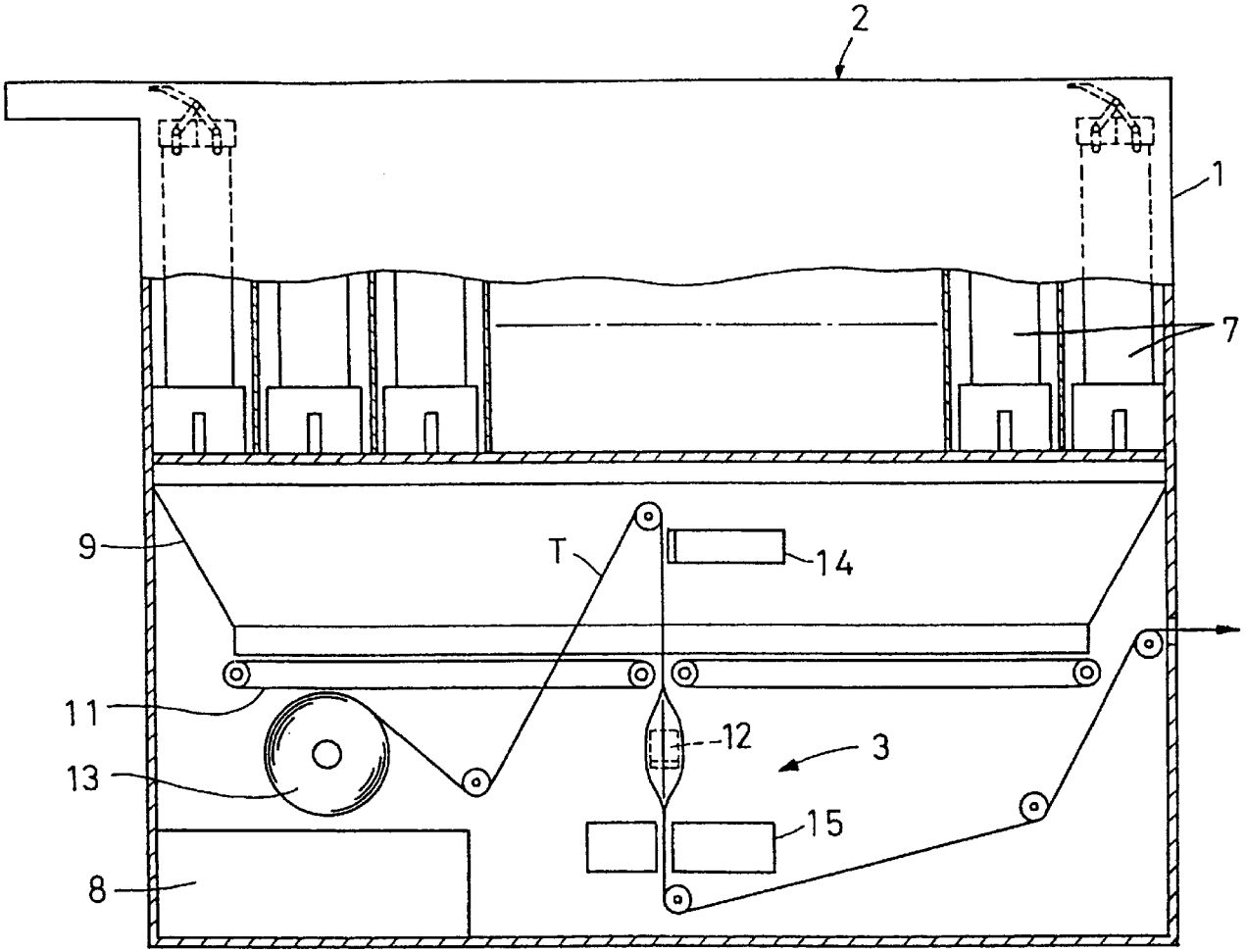
FIG. 2 is a vertical sectional side view of the tablet packing device of FIG. 1.
Figure 3:
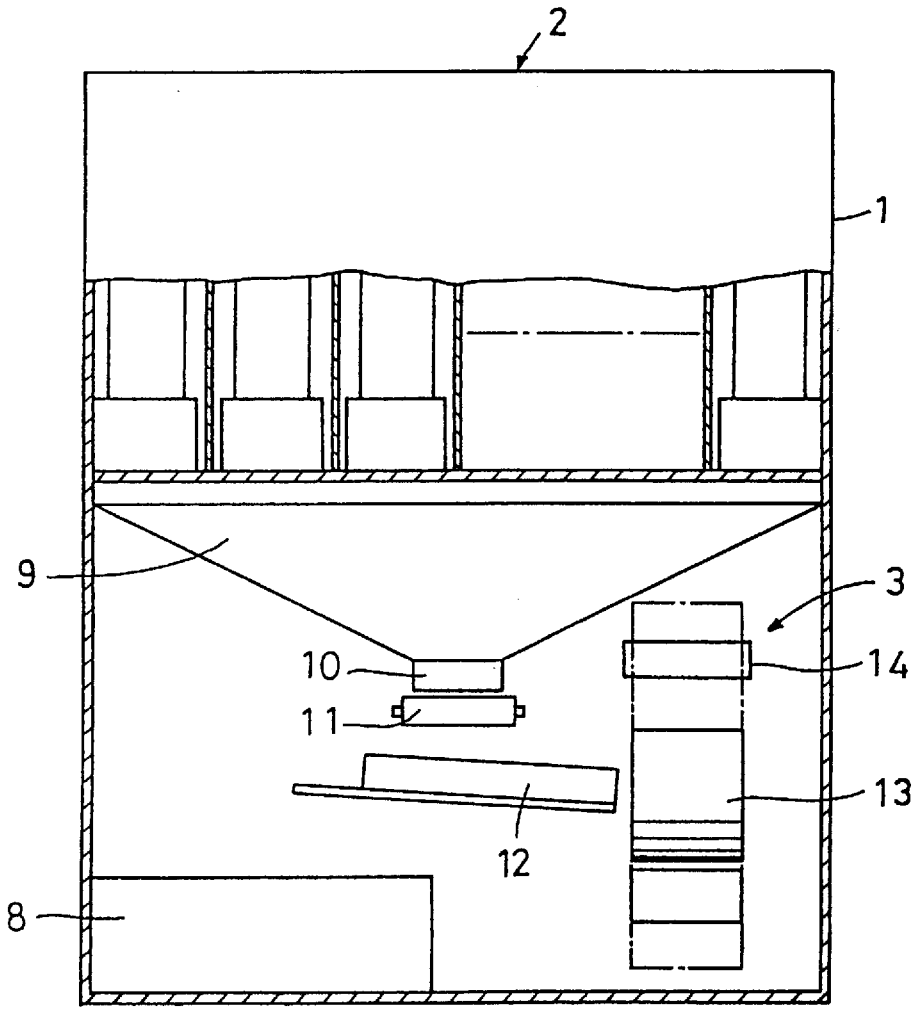
FIG. 3 is a side view in cross-section of the tablet packing device of FIG. 1.

FIGS. 1–3 show a tablet packing device of the first embodiment. It has a housing 1 in which are mounted a tablet storage unit 2 and a packing unit 3. This packing device is basically the same in structure as conventional packing devices such as that disclosed e.g. in Unexamined Japanese Patent Publication 3-85202. Therefore, its structure is described only briefly.

The tablet storage unit 2 comprises a plurality of tablet cases 7 detachably inserted in vertically elongated cells 6 defined in the housing 1 at its upper part by partitioning plates 5. Different kinds of tablets are stored in the respective cases 7. While not shown, each tablet case 7 has a tablet storage space and a means for dropping tablets one by one from the tablet storage space. This means is controlled by a control unit 8, which will be described later. Every time a tablet is dropped by the tablet dropping means, a detection signal is sent to the control unit 8.

Tablets dropped from the tablet cases 7 are collected by a hopper 9 under the storage unit 2 at a predetermined point, dropped through a guide 10 onto a conveyor 11, sent by the conveyor 11 to a predetermined position, and dropped into a packing sheet T by a guide arm 12. The sheet T is fed by a feed roller 13 in a double-folded state with its open side up. A printer 14 prints necessary information on the sheet at a predetermined longitudinal position. Then, the guide arm 12 is inserted into the sheet T through its open side to drop tablets therein, and the sheet is sealed by a T- or L-shaped heat sealer 15 to form a pouch with the tablets packed therein.

Figure 4:
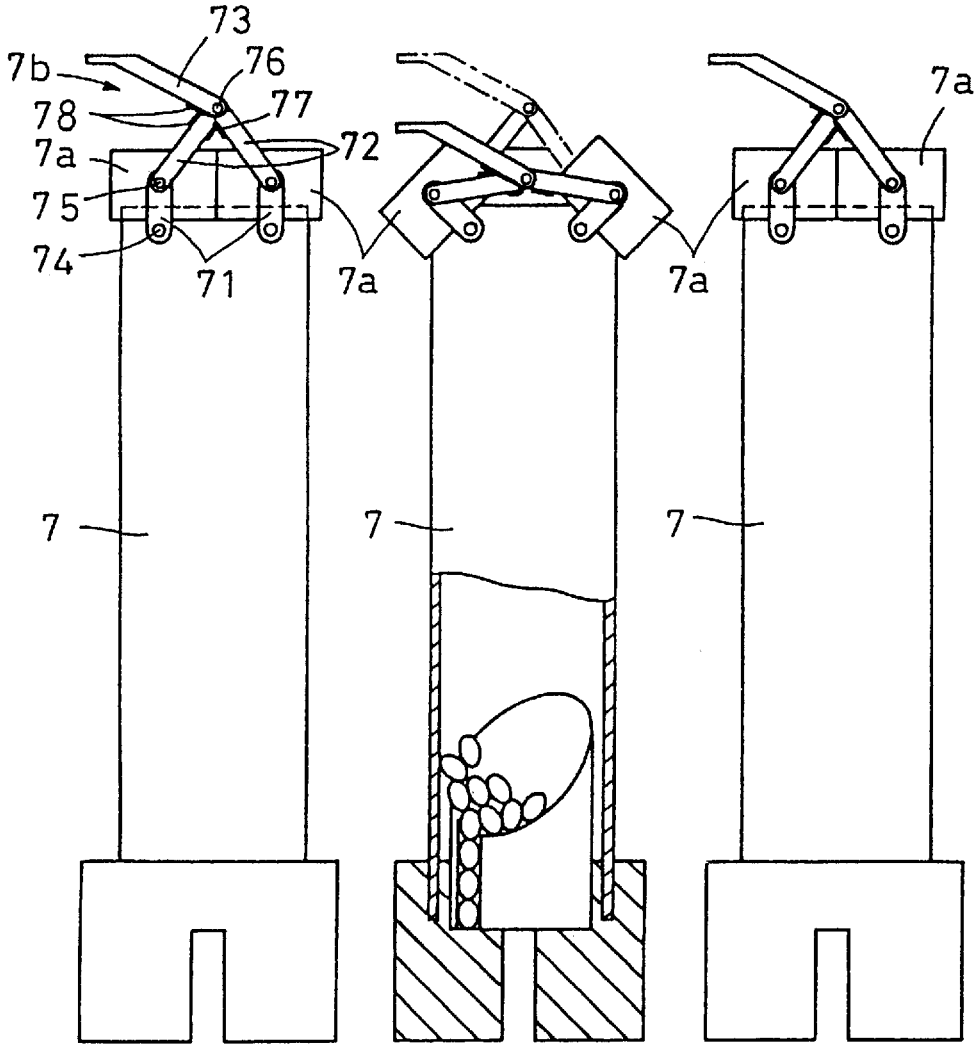
FIG. 4 is a detailed sectional view of a tablet resupply unit.

FIG. 4 is a side view of a tablet case 7. It has a top cover 7*a* comprising two separate members that can be pivoted into an open position by a linkage 7*b*. The cover 7*a* is normally closed to keep the tablets in the case from getting damp.

The linkage 7*b* comprises pivot links 71, coupling links 72 and an opening lever 73. Each pivot link 71 has one end thereof pivotally mounted on a shaft 74 mounted on the top end of the tablet case 7 and the other end pivotally mounted on a shaft 75 mounted on the cover 7*a*. The two coupling links 72 are coupled together at their top ends. A spring 77 is provided between the coupling links 72, and another spring 78 is provided between one of the links 72 and the opening lever 73.

Figure 5:
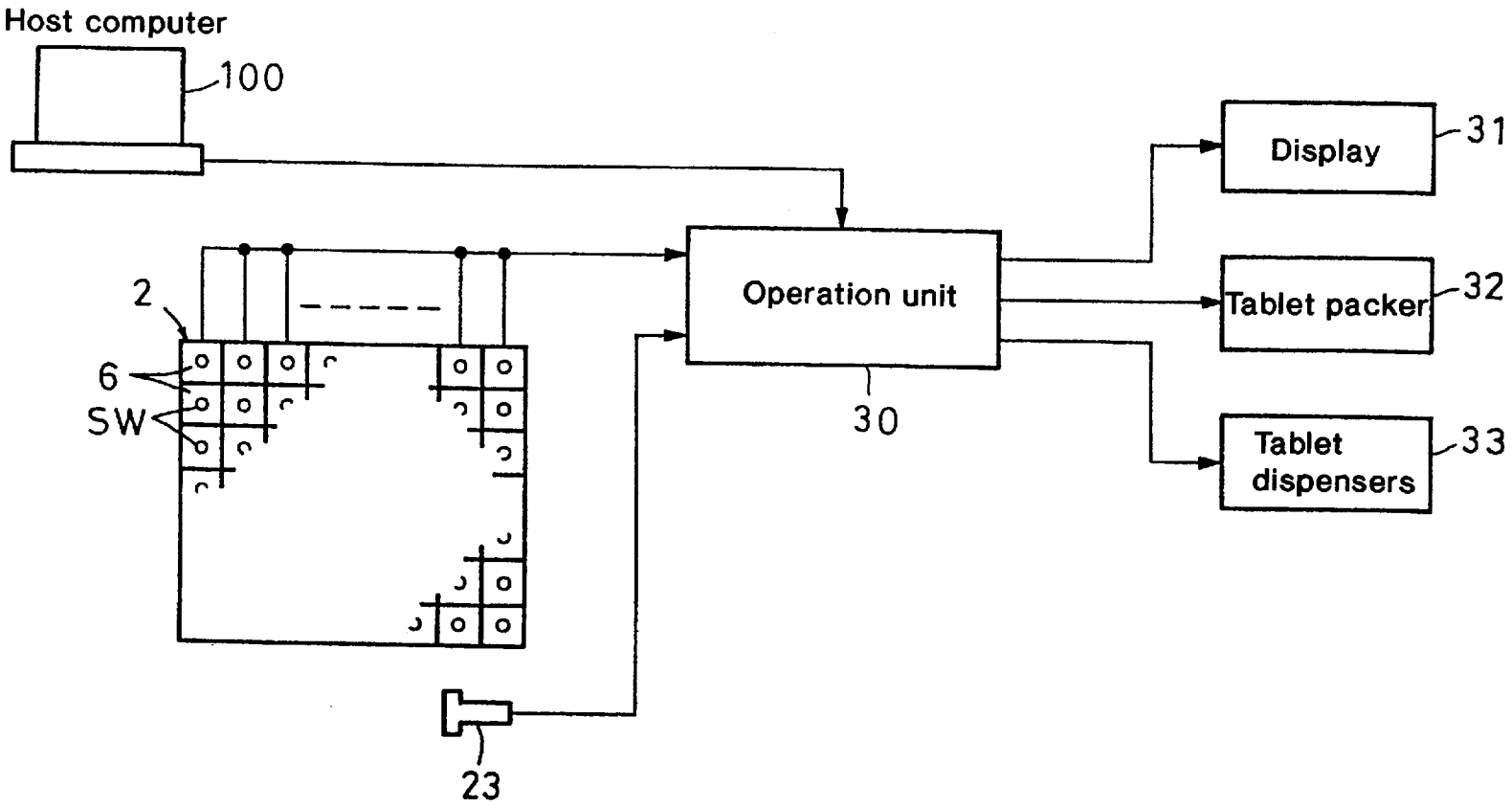
FIG. 5 is a block diagram of the entire control unit.

FIG. 5 shows a block diagram of a circuit for controlling driving units of the tablet packing device. In the figure, a host computer 100 is shown. It sends data on prescribed drugs to an operation unit 30. The prescribed drug data include patients' names or codes, drug codes, doses, etc.

As shown, the operation unit 30 is connected to a display 31, a tablet packer 32, tablet dispensers 33, etc. and control them by sending control signals to mainly pack tablets. The tablet packer 32 drives the feed roller for feeding tablet packing sheet T, printer 14, heat sealer 15, conveyor 11, etc.

When prescribed drug data are sent to the operation unit 30, it activates a tablet dispenser 33 of a tablet case 7 that keeps tablets designated by the drug data to drop tablets from the case 7 one by one. Every time a tablet dropped from the case 7 passes a predetermined point, a switch signal SW is produced and sent to the operation unit 30. Every time a switch signal is received by the operation unit 30, a subtraction counter subtracts one from the number of tablets to be discharged stored in the memory of the operation unit 30.

Tablets discharged from the tablet case 7 in each cell 6 of tablet storage unit 2 are detected by a switch SW indicated by ○ in FIG. 5.

As shown in FIG. 1, a table 52 is provided on the outside of the housing 1. A bar code reader 51 is placed on the table 52. It is used to read a bar code 54 on a tablet container 53 placed on the table 52 to check if the tablets in the container 53 are of the designated kind. The data read by the bar code reader 51 are sent to the operation unit 30.

In this embodiment, tablets are replenished in the following manner.

Initially, a predetermined number of tablets are supplied into each tablet case 7. Each tablet case 7 may contain a different kind of tablets from the other tablet cases 7, or more than one case 7 may contain the same kind of drugs. The tablet cases 7 are set in the tablet storage unit 2. When drug data are sent to the drug packing device from the host computer 100, it activates the tablet dispensers 33 of the tablet cases 7 containing tablets designated by the drug data to drop tablets one by one from the corresponding cases 7. The dropped tablets are sent to the tablet packer 32 and packed in the packing sheet for delivery to patients.

Figure 6:
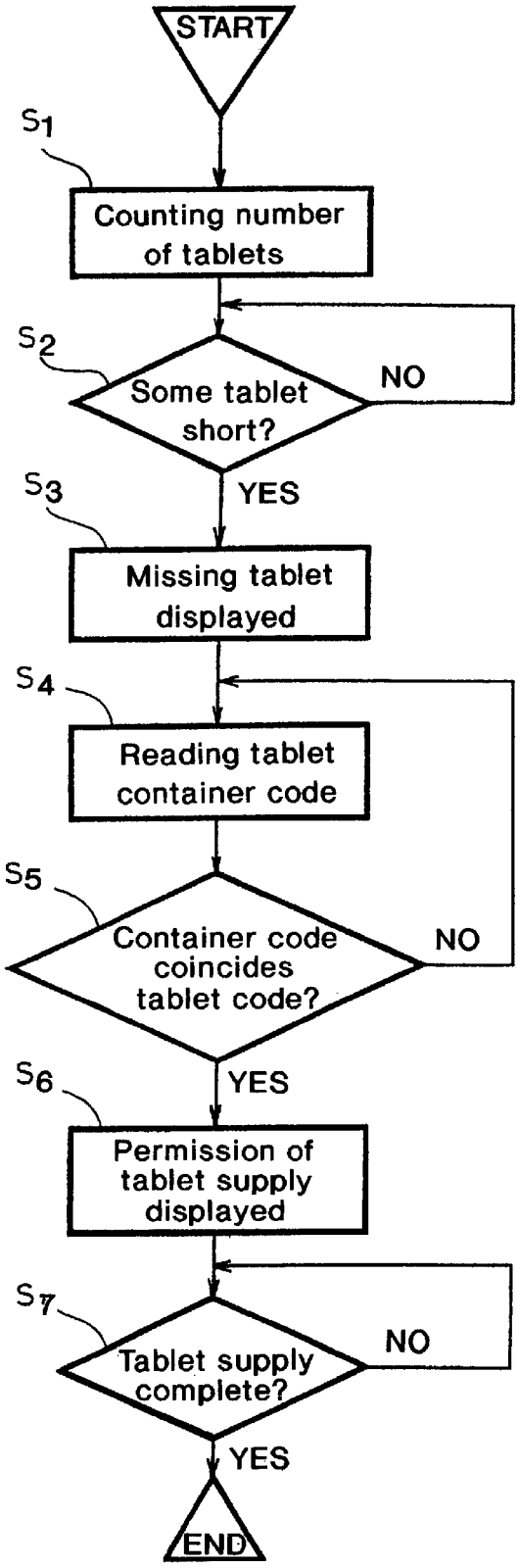
FIG. 6 is a flowchart showing the tablet resupply steps.

When tablets are discharged from the tablet storage unit 2 for a large number of patients and the numbers of tablets in some tablet cases decrease below a predetermined value, or tablets in some tablet cases completely run out, tablets are resupplied manually into these tablet cases. This operation is carried out following the steps shown by the flowchart of FIG. 6.

In Step S1, the number of tablets in each case is counted by subtracting the number of tablets discharged from each tablet case, which is obtained by counting the number of switch signals SW produced every time a tablet is discharged from the case 7, from the maximum number of tablets the case 7 can hold.

If the number counted in Step S1 is below a predetermined number (YES in Step S2), the code of the number (coordinate) of the cell housing the particular tablet case is shown on the display 31 in Step S3.

Then, the bar code 54 on the tablet container 53 placed on the table 52 is read by the bar code reader 51 and compared with the code of tablets to be supplied into the particular tablet case (Step S5).

If these codes are identical, permission to supply tablets into the tablet case is indicated in Step S6. In response, an operator takes a required number of tablets out of the tablet container 53, opens the lid by depressing the lever 73 of the particular tablet case, and drops the tablets into the case.

Then in Step S7, the operation unit checks if the particular tablet case has be replenished with tablets through an unillustrated height detection sensor comprising a light emitter and an interceptor provided at the top of the tablet storage unit. If a plurality of tablet cases 7 run short of tablets at the same time, they are replenished one by one in the above manner.

In the above arrangement, the code of tablets to be supplied into a particular tablet case is compared with a code on the tablet container placed on the table, and if these codes are judged to be identical, tablets in the container are taken out and supplied into the tablet case.

But instead, a bar code 17 provided on the cover of each tablet case 7, which represents the kind of tablets in the case 7, and the bar code 54 on the tablet container may be read (either may be read first) and compared with a predetermined identification code. If they coincide, permission to supply tablets is given. This method is also applicable to the second and third embodiments.

Data necessary for tablet replenishment are stored in the memory and can be indicated on the display or printed out at any time. These data are preferably shown on the display or printed out in the form of a list showing how tablets have been resupplied into necessary tablet cases in an orderly manner.

Such a list has to contain at least the following data:

ID code of the tablet container

ID code of a tablet case that has been replenished results of code matching number and code of tablets replenished information showing how tablets have been replenished (error signals produced if the codes are not identical, reset signals, re-reading of ID codes, elapsed time, etc.)

In the following embodiments, tablets are stored not in tablet cases inserted in the respective cells but directly in the cells.

Figure 7:
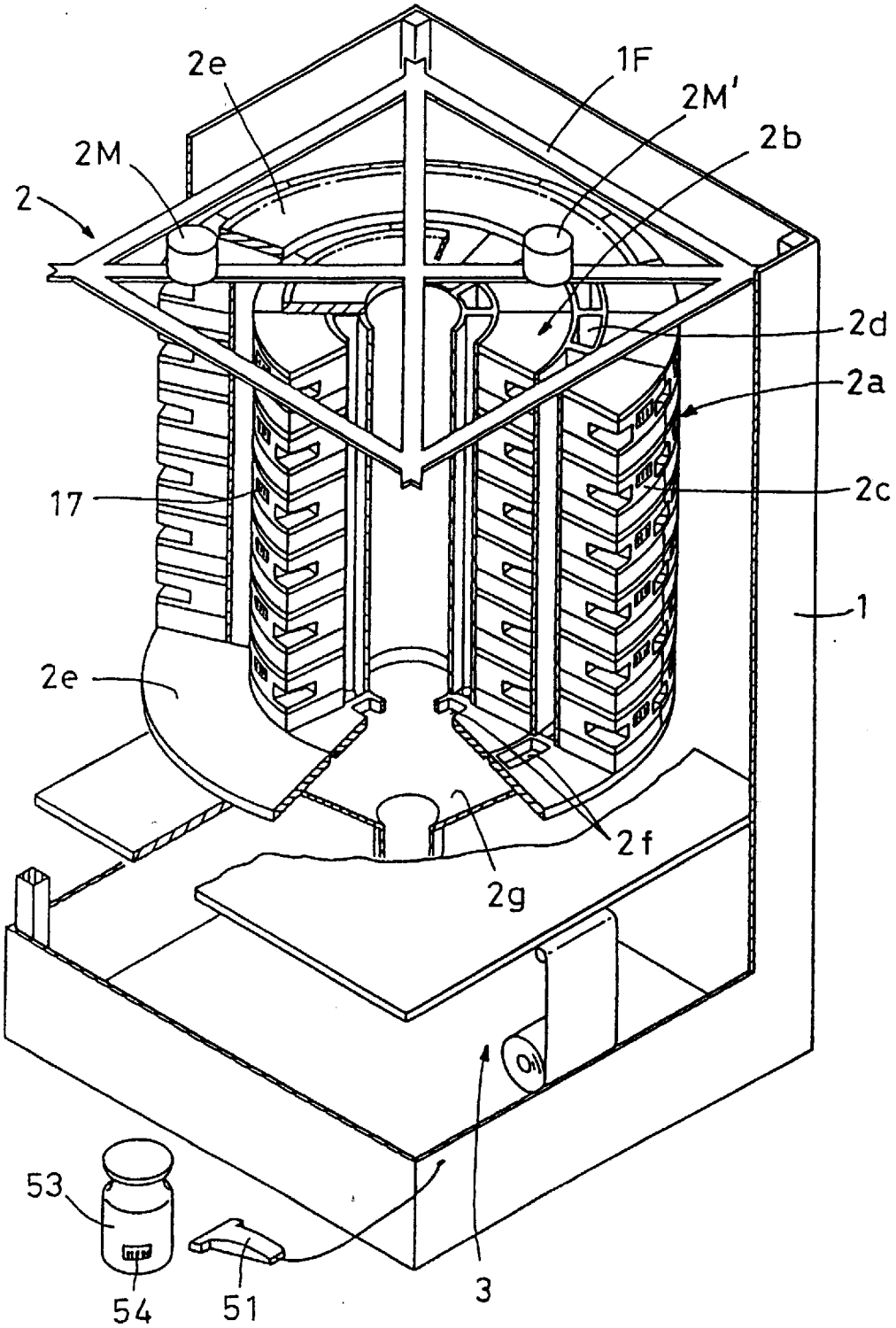
FIG. 7 is a schematic perspective view of an entire tablet packing device of a second embodiment of the present invention.
Figure 8:
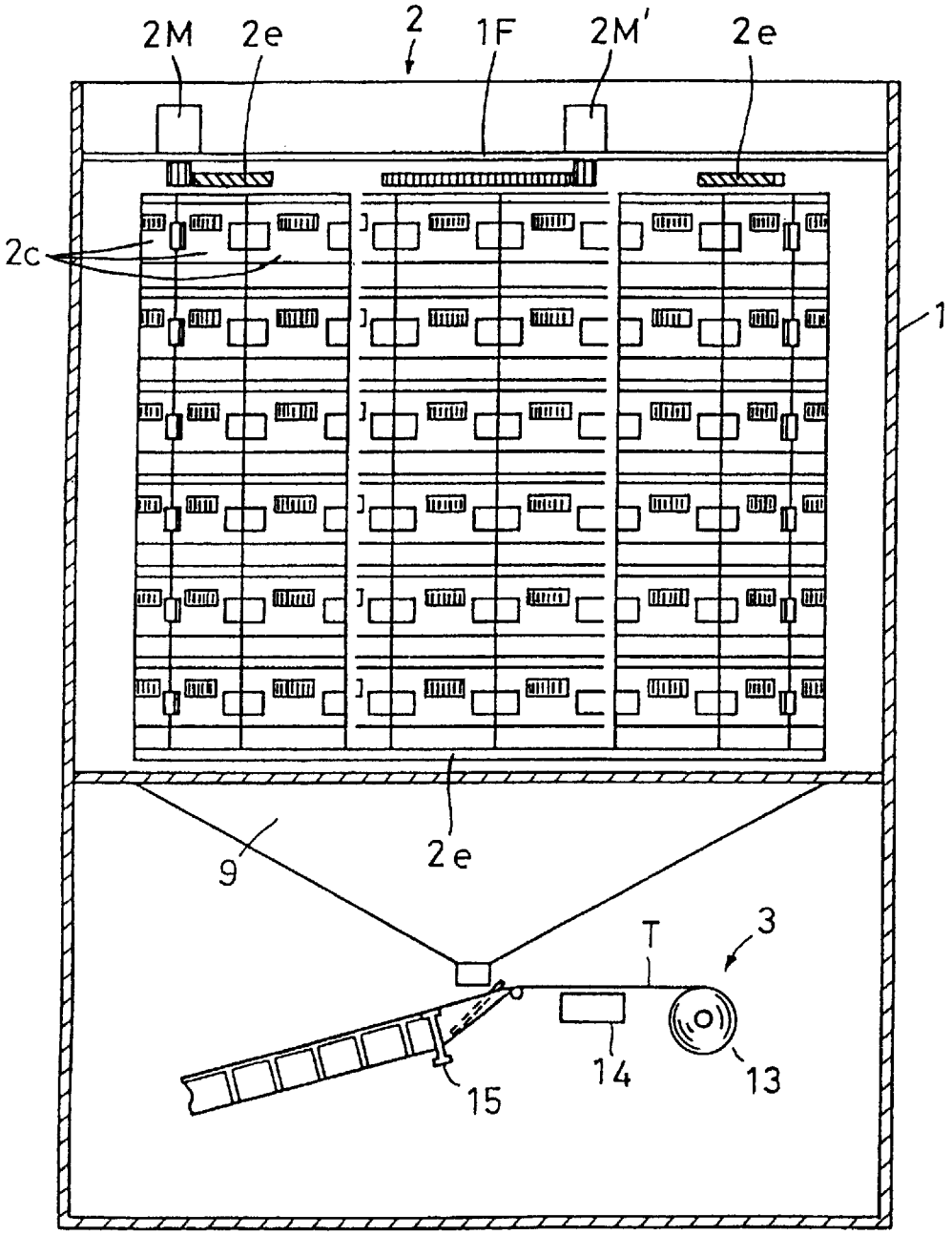
FIG. 8 is a sectional side view of the tablet packing device of FIG. 7.
Figure 9A:
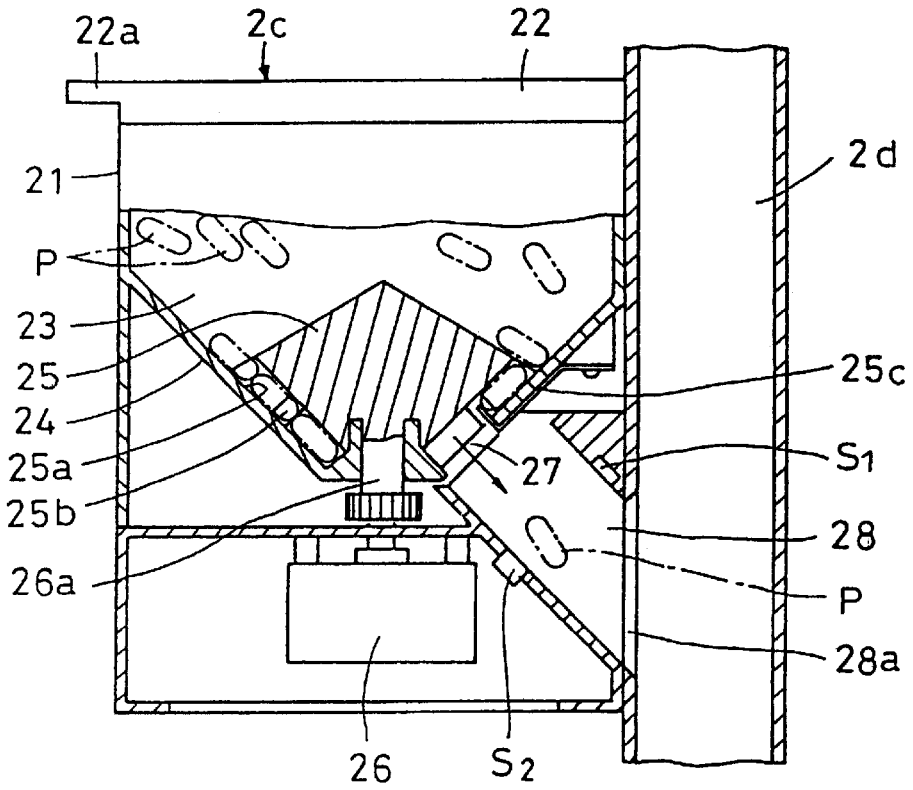
FIG. 9A is a sectional view of a tablet storage cell.
Figure 9B:
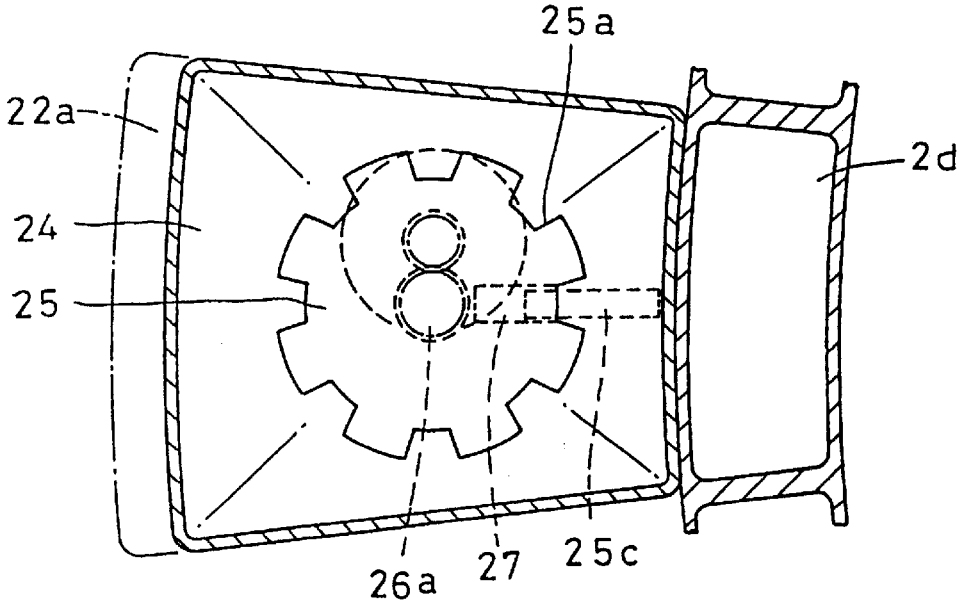
FIG. 9B is a plan view of the tablet packing device of FIG. 9A.

FIGS. 7–9 are schematic and detailed views of a tablet packing device of the second embodiment. As shown in FIGS. 7 and 8, this tablet packing device has a tablet storage unit 2 in the upper part of the housing 1 and a packing unit 3 in the lower part of the housing 1. The tablet storage unit 2 is a cylindrical member comprising an inner rotor 2*b* and an outer rotor 2*a*. Each of the rotors 2*b* and 2*a* has a plurality of tablet storage cells 2*c*.

The cells 2*c* of each of the rotors 2*b* and 2*a* arranged in each vertical column communicate with a common tablet discharge passage 2*d*. The rotors 2*b* and 2*a* are supported on inner and outer disks 2*e*, respectively. The passages 2*d* have their bottom ends in abutment with the disks 2*e* and communicate with a hopper 2*g* under the disks 2*e* through holes 2*f* formed in the disks 2*e*.

The inner and outer rotors 2*b* and 2*a* can be rotated about 360° and about 300°, respectively, by an inner and an outer motor 2M' and 2M mounted on a crossbar of a support frame 1F fixed to the housing 1 and having their downwardly protruding pinions in mesh with teeth formed on the outer circumferences of inner and outer top disks 2*e*. The cells 2*c* of the inner rotor 2*b* cover the entire area of the inner rotor 2*b*. But the outer rotor 2*a* has an area where there are no cells 2*c*, though this area is not shown. In this cell-missing area of the outer rotor 2*a*, a door is provided through which any one of the cells 2*c* one of the inner rotor 2*b* is accessible to supply tablets. The cells 2*c* are drawers which can be drawn radially outwardly. By drawing out any necessary cell 2*c*, tablets are supplied therein.

FIG. 9 shows a different type of tablet storage cell 2*c*. It has a cover 22 provided on top of the case 21 and having an edge plate 22*a* at its front end. A hopper plate 24 is provided in the case, defining a tablet storage space 23. Mounted on the hopper plate 24 is a rotary type tablet feeding/arranging block 25 having a bottom surface inclined at the same angle as the tapered top of the hopper plate 24. The block 25 has holes 25*a* formed along the outer circumference at equal intervals. Tablets P fit in the respective holes 25*a* and are fed to the center of the hopper plate like ants trapped in an antlion's pitfall.

The hopper plate 24 has a hole 27 near its center of rotation, and a tablet stopper means 25*c* provided radially outside of the hole 27. When the block 25 is rotated and one of the holes 25*a* aligns with the hole 27, one tablet P in this hole 25*a* drops through the hole 27. The other tablets in this hole 25*a* are prevented from moving toward the hole 27 by the stopper means 25*c*. Thus, by rotating the block 25 continuously, tablets P on the hopper plate are discharged one by one into the tablet discharge passage 2*d* through a passage 28 having a bottom opening 28*a* communicating with the passage 2*d*. The stopper means 25*c* has a bent inner end received in a circular groove 25*b* formed in the bottom of the block 25.

The block 25 is rotated by a motor 26 having its output shaft 26*a* coupled to the center of the block 25. A sensor S is provided in the passage 28 to detect the passage of tablets P. The sensor S comprises a light emitter S1 and a light interceptor S2. Every time the sensor S detects the passage of a tablet P, it sends a detection signal to the control unit 8. The control unit 8 can thus calculate the number of tablets remaining in each cell 2*c* and determine if this number is smaller than a predetermined number.

The tablet packing unit 3 of this embodiment is substantially the same in structure as that of the first embodiment. The hopper 9 is slightly different in shape from that of the first embodiment. No guide 10 or conveyor 11 is used. Otherwise, this embodiment is the same as the first embodiment.

The same parts are denoted by the same numerals and their description is omitted. Functionally, this embodiment is basically the same as the first embodiment in that prescribed tablets are discharged from designated cells 2*c* of the inner and outer rotors 2*b*, 2*a* and packed in packing sheet.

But this embodiment differs from the first embodiment in that the data on the tablets stored in the inner and outer rotors 2*b*, 2*a* are stored in the memory in two separate memory maps which are in the form of developments of the rotors 2*b*, 2*a*.

In order to supply tablets into a designated cell 2*c*, the control unit 8 turns either the rotor 2*a* or 2*b* to move the designated cell 2*c* to the tablet supply position.

In this state, the bar code 54 on the tablet container 53 is read by the bar code reader 51 and compared with the code of tablets to be supplied to the designated cell. If these codes coincide, this fact is indicated on the display. An operator then supplies tablets taken out of the container 53 into the cell 2*c*.

Figure 10:
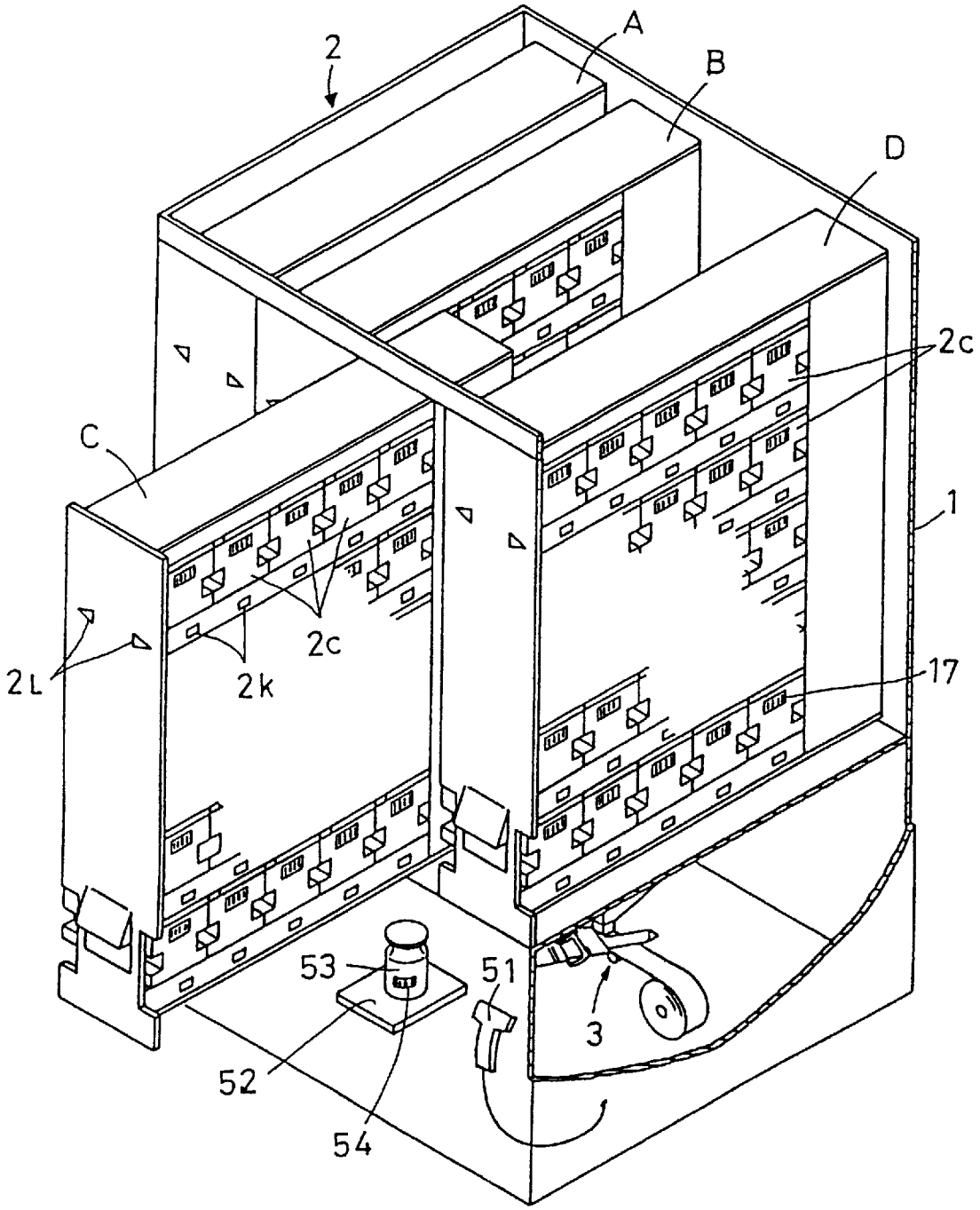
FIG. 10 is a schematic perspective view of an entire tablet packing device of a third embodiment of the present invention.
Figure 11:
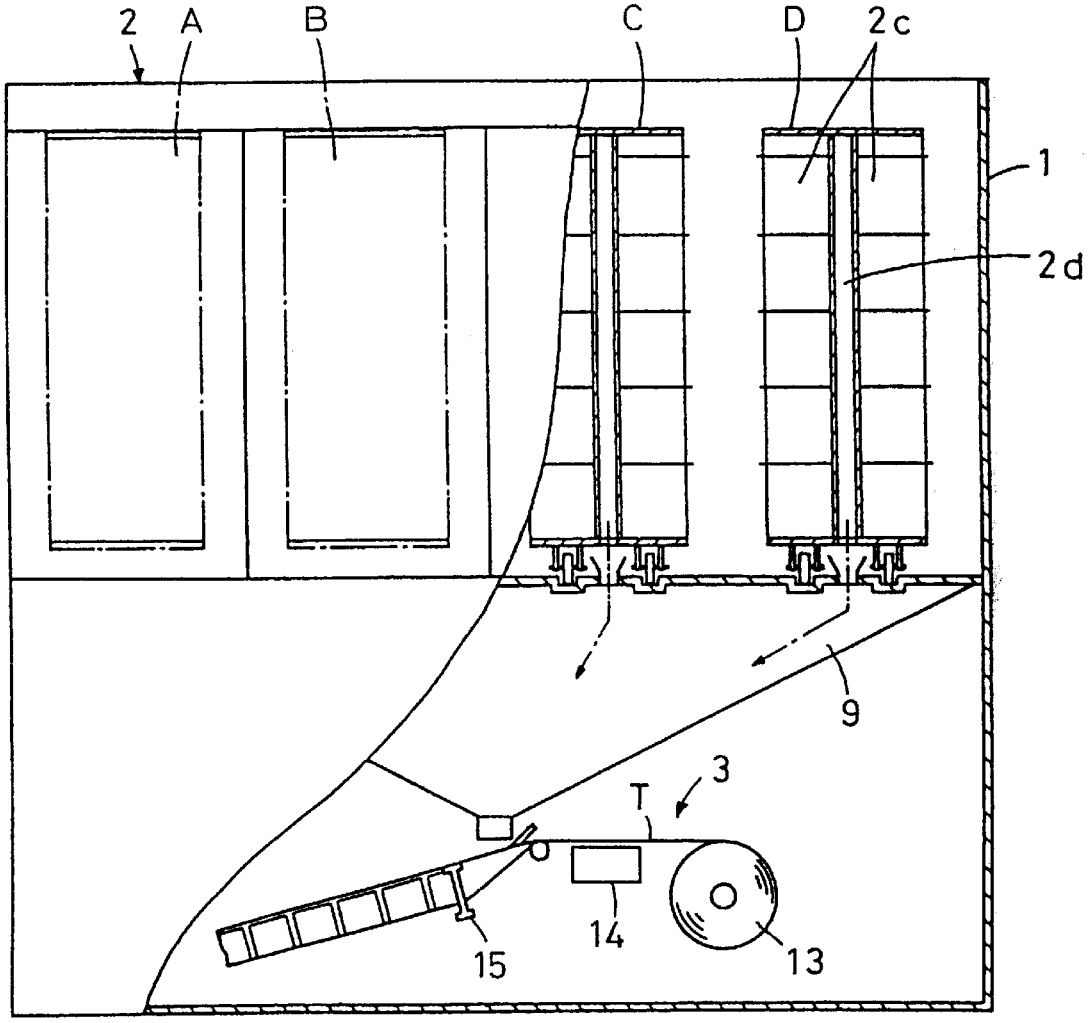
FIG. 11 is a side view in vertical section of the tablet packing device of FIG. 10.

FIGS. 10 and 11 schematically show a tablet packing device of the third embodiment, which includes a tablet storage unit 2 comprising a plurality of (e.g. 4, as shown) rows of slide shelves A, B, C and D. Each slide shelf carries a plurality of tablet storage cells 2*c* on either side thereof. Each drawer can be drawn out in the direction perpendicular to the direction in which the slide shelves are slid, away from the drawer on the opposite side of the same shelf. The same packing unit 3 as used in the first and second embodiments is provided under the tablet storage unit 2. Each cell 2*c* may or may not be of the same type as shown in FIG. 9 of the second embodiment.

Tablet discharge passages 2*d* (see FIG. 11) are provided between the cells 2*c* on the opposite sides of each shelf. Tablets P discharged into the passages 2*d* are collected by a common hopper 9, dropped into the packing unit 3 and packed by the packing unit 3, as in the first and second embodiments.

Tablets are manually replenished in substantially the same manner as in the other embodiment. That is, the bar code 54 on the tablet container 53 is read by the bar code reader 51 and compared with the code of tablets to be supplied to a designated cell. If these codes coincide, this fact is indicated on the display. An operator then supplies tablets taken out of the container 53 into the cell 2*c*.

As shown in FIG. 10, an indicator lamp 2L is provided on each of the slide shelves A, B, C and D. A smaller indicator lamp 2K is provided on each cell at its front lower part. When any cell runs short of tablets, the computer turns on the corresponding lamps so that an operator can instantly see which cell of which shelf is short of tablets.

As described above, according to the present invention, tablets designated by the drug data are dropped from a corresponding tablet storage space, guided to a predetermined position by a hopper, and packed. When any tablet storage space run short of tablets, an operator opens the cover of this space, checks the code of tablets to be supplied into this space with the code on a tablet container. If these codes are identical, the operator supply tablets in the container into the space. It is thus possible to prevent tablets from being put in a wrong tablet storage space by mistake.

According to the present invention, the above two codes are further compared with a code attached to the cover of the particular tablet storage space to more positively eliminate the error of putting tablets in a wrong tablet storage space.

What is claimed is:

1. A tablet dispenser comprising:

a tablet storage unit having a plurality of tablet storage spaces in which a number of different kinds of tablets can be stored, each of said tablet storage spaces having a cover which can be manually opened;

a tablet discharge means for discharging tablets from a designated one of said tablet storage spaces;

a hopper provided under said tablet storage unit for receiving tablets discharged from said tablet storage spaces;

a tablet packing unit for receiving tablets from said hopper and packing said tablets;

a control unit;

a display means connected to said control unit; and a data reader connected to said control unit for reading first data identifying the name and type of tablets stored in a tablet container, wherein said control unit includes a detector means for detecting that a supply of tablets are low or are depleted in any one of said tablet storage spaces and displaying, on said display means, second data identifying the position of said detected tablet storage spaces in which the supply of tablets are low or depleted, and third data identifying the name and type of tablets to be put in any one of said table storage spaces in which a low or depleted supply of tablets has been detected, and a comparison means for comparing said first and third data and displaying, on said display means, whether or not said first and third data coincide.

2. The tablet dispenser as claimed in claim 1, further comprising a second data reader for reading fourth data provided on said cover of each of said plurality of tablet storage spaces, wherein said fourth data identifies the name and type of tablets to be put in each of said corresponding tablet storage spaces, and said comparison means is adapted to compare said first, third and fourth data and display, on said display means, whether or not said first, third and fourth data coincide.

* * * * *